US012310480B1

(12) United States Patent
Yi

(10) Patent No.: US 12,310,480 B1
(45) Date of Patent: May 27, 2025

(54) WIDE-JAW-OPENING NAIL CLIPPER

(71) Applicant: Shenzhen Ousen Technology Co., LTD, Guangdong (CN)

(72) Inventor: Wei Yi, Guangdong (CN)

(73) Assignee: Shenzhen Ousen Technology Co., LTD, Shenzhen (CN)

( * ) Notice: Subject to any disclaimer, the term of this patent is extended or adjusted under 35 U.S.C. 154(b) by 0 days.

(21) Appl. No.: 19/053,483

(22) Filed: Feb. 14, 2025

(30) Foreign Application Priority Data

Feb. 7, 2025 (CN) ..... 202510136277.5

(51) Int. Cl.
*A45D 29/02* (2006.01)

(52) U.S. Cl.
CPC ..... *A45D 29/023* (2013.01)

(58) Field of Classification Search
CPC ..... A45D 29/02; A45D 29/023
See application file for complete search history.

(56) References Cited

U.S. PATENT DOCUMENTS

2011/0061239 A1* 3/2011 Pacio ..... A45D 29/02 30/28
2016/0073760 A1* 3/2016 Rizzi ..... A45D 29/06 30/28
2016/0286931 A1* 10/2016 LaTorre ..... A45D 29/023

FOREIGN PATENT DOCUMENTS

CN 216455239 U * 5/2022
KR 200195565 Y1 * 9/2000
KR 200348034 Y1 * 4/2004
KR 100526314 B1 * 11/2005
WO WO-2008108554 A1 * 9/2008 ..... A45D 29/02

OTHER PUBLICATIONS

English translation of KR-100526314-B1, dated Nov. 8, 2005.*
English translation of CN-216455239-U, dated May 10, 2022.*
English translation of KR-200348034-Y1, dated Apr. 28, 2004.*

* cited by examiner

*Primary Examiner* — Hwei-Siu C Payer

(57) ABSTRACT

Disclosed is a wide-jaw-opening nail clipper, and the nail clipper includes: a first blade head portion formed at a first handle, and an upper blade formed at the first blade head portion, where an upper blade tip extends forward farther than an upper blade tail; a second blade head portion formed at a second handle, where the second blade head portion is provided with a butt-joint position, a lower blade is formed at the second blade head portion, a lower blade tip extends forward farther than a lower blade tail, and the upper blade tip and the lower blade tip both form a pointed cone shape; and the first blade head portion is rotatably connected to the second blade head portion, an elastic member is installed inside a mounting groove, and the first blade head portion and the second blade head portion together form a trimming blade head.

10 Claims, 6 Drawing Sheets

WIDE-JAW-OPENING NAIL CLIPPER

CROSS REFERENCE TO RELATED APPLICATIONS

The present application claims the benefit of Chinese Patent Application No. 202510136277.5 filed on Feb. 7, 2025, the contents of which are incorporated herein by reference in their entirety.

TECHNICAL FIELD

The present disclosure relates to the technical field of nail clippers, and in particular to a wide-jaw-opening nail clipper.

BACKGROUND

Nail clippers of the prior art are designed to be flat-headed and linear, and users need to bend their wrists outward when trimming their nails, which is burdensome and inconvenient for patients with arthritis, pregnant women, and obese individuals. Further, flat-headed and crescent-shaped trimming blade edges are not suitable for trimming of ingrown toenails. For a nail clipper composed of handles, a connecting column and a V-shaped blade holder, a width between blade edges is limited by design of the V-shaped blade holder, and the connecting column is connected to the handles through a clamping hook structure, which can be easily detached during use and cannot withstand forceful pressing during trimming. For a wide-jaw-opening nail clipper with two handles, the two handles have blade edges respectively and are rotatably connected to each other, an external spring is arranged between the two handles, and such design can increase the width between the two blade edges and withstand forceful trimming better.

When the above two types of nail clippers are used, problems of nail clipping and nail debris splatter easily occur. To solve the problems, some manufacturers choose to arrange barrier plates on both sides of two blade edges, but due to a limited width between the two blade edges and blade edge sharpening procedures, the barrier plates cannot achieve complete enclosing and blocking as a gap exists between upper and lower barrier plates, which results in that a small amount of nail debris splatters during trimming.

Therefore, there is an urgent need for a wide-jaw-opening nail clipper capable of solving one or more of the above problems.

SUMMARY

In order to solve one or more problems in the prior art, the present disclosure provides a wide-jaw-opening nail clipper. The technical solution used by the present disclosure in order to solve the problems above is as follows: the nail clipper includes: a first handle and a second handle;

a first blade head portion is formed at a head end of the first handle, the first blade head portion is provided with a through slot that penetrates through both upper and lower sides thereof, the through slot is configured for insertion of the second handle, an upper blade is formed at a front end of the first blade head portion, the upper blade extends downward and forward, left and right ends of the upper blade are denoted as an upper blade tip and an upper blade tail respectively, the upper blade tip extends forward farther than the upper blade tail, and the upper blade tip forms a pointed cone shape;

a second blade head portion is formed at a head end of the second handle, the second blade head portion is provided with a butt-joint position, the butt-joint position is provided with a mounting groove, a lower blade is formed at a front end of the second blade head portion, the lower blade extends upward and forward, left and right ends of the lower blade are denoted as a lower blade tip and a lower blade tail respectively, the lower blade tip extends forward farther than the lower blade tail, and the lower blade tip forms a pointed cone shape;

the first blade head portion is rotatably connected to the second blade head portion, an elastic member is installed inside the mounting groove, both ends of the elastic member abut against the first blade head portion and the second blade head portion respectively, the through slot defines an opening width between the upper blade and the lower blade, and the first blade head portion and the second blade head portion together form a trimming blade head that tilts upward and forward.

In some examples, the nail clipper further includes: an elastic soft sleeve, where the elastic soft sleeve is mounted on the first blade head portion and the second blade head portion, a head end of the elastic soft sleeve extends toward the trimming blade head, and a tail end of the elastic soft sleeve extends away from the trimming blade head; and blocking portions are formed on both sides of the head end of the elastic soft sleeve, the blocking portions protrude from the head end of the elastic soft sleeve, the blocking portions are located on both sides of the upper blade and the lower blade, and the blocking portions are configured to block nail debris generated during trimming. Further, the blocking portions are outwardly convex and arc-shaped.

In some examples, the elastic member is V-shaped. Further, the first blade head portion is provided with a first limiting groove, the mounting groove and the first limiting groove limit the elastic member, and a rotating shaft penetrates through the first blade head portion and the mounting groove and connects the first blade head portion and the second blade head portion, where the rotating shaft penetrates through a V-shaped curve of the elastic member.

In some examples, a first through hole is formed at an end of the first handle away from the first blade head portion, and a second through hole is formed at an end of the second handle away from the second blade head portion.

In some examples, the first handle and/or the second handle is provided with a file. Further, the files are nano-glass files.

The technical effects achieved by the present disclosure are as follows: the trimming blade head that tilts upward and forward allows the user to hold the nail clipper vertically during trimming, which reduces an amplitude of wrist bending during the trimming; the trimming blade head with pointed cone-shaped blades facilitates trimming of ingrown nails by the user;

a traditional external spring structure is changed to an internal spring structure, which simplifies a structure of the two handles, and reduces manufacturing costs, where the internal spring is more durable than the traditional external spring; and arrangement of the nano-glass files facilitates nail polishing by the user, and the nano-glass files are superior to traditional metal files in terms of polishing properties; and the elastic soft sleeve enables full enclosing of both sides of the trimming blade head, which minimizes the splatter of nail debris during the trimming, neither affects normal trimming in a blade direction, nor obstructs the user's observation of the blades during the trimming, and nor limits the opening width of the blades.

REFERENCE NUMERALS IN THE FIGURES

1. first handle; 10. first blade head portion; 100. through slot; 101. first limiting groove; 11. upper blade; 11A. upper blade tip; 11B. upper blade tail; 12. first file; 13. first through hole; 2. second handle; 20. second blade head portion; 201. lower blade; 201A. lower blade tip; 201B. lower blade tail; 21. butt-joint position; 210. mounting groove; 22. second file; 23. second through hole; 3. elastic soft sleeve; 30. head end; 31. tail end; 32. blocking portion; 4. elastic member; 5. rotating shaft; and 6. trimming blade head.

DETAILED DESCRIPTIONS OF THE EMBODIMENTS

In order to make the above objectives, features and advantages of the present disclosure more apparent and easily understood, specific embodiments of the present disclosure will be described in detail below with reference to the accompanying drawings. Numerous specific details are set forth in the following description to facilitate a thorough understanding of the present disclosure. However, the present disclosure may be implemented in many other ways different from those described herein, similar improvements may be made by those skilled in the art without departing from the connotation of the present disclosure, and therefore the present disclosure is not limited by specific examples disclosed below.

Figure 1:
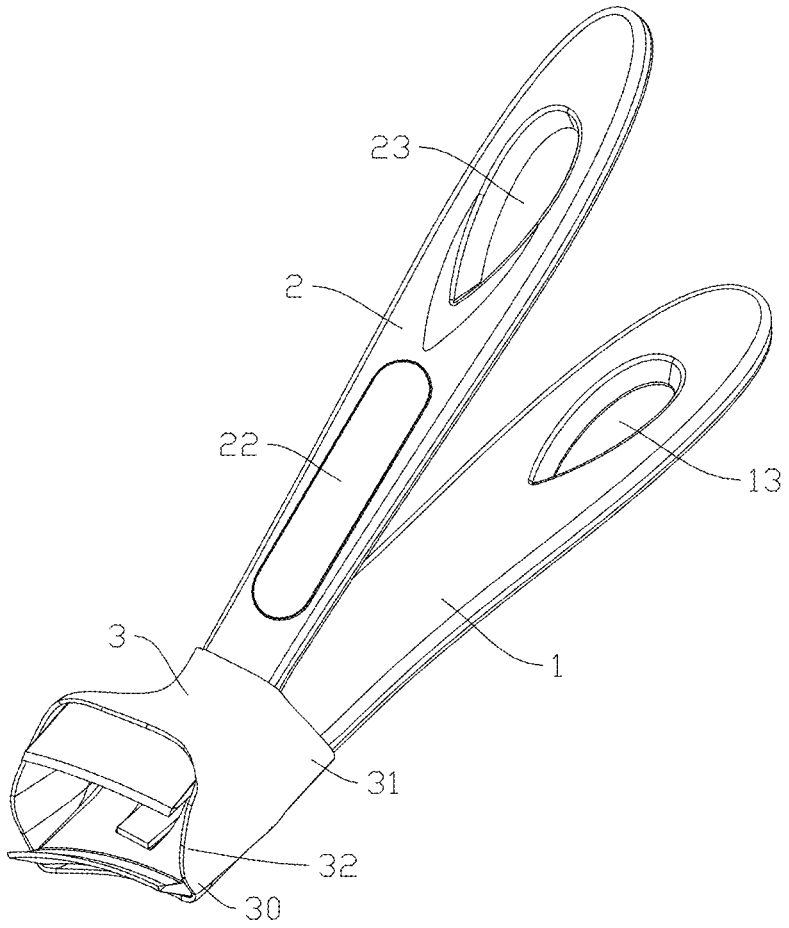
FIG. 1 is a schematic diagram of a nail clipper of the present disclosure with an elastic soft sleeve installed.
Figure 2:
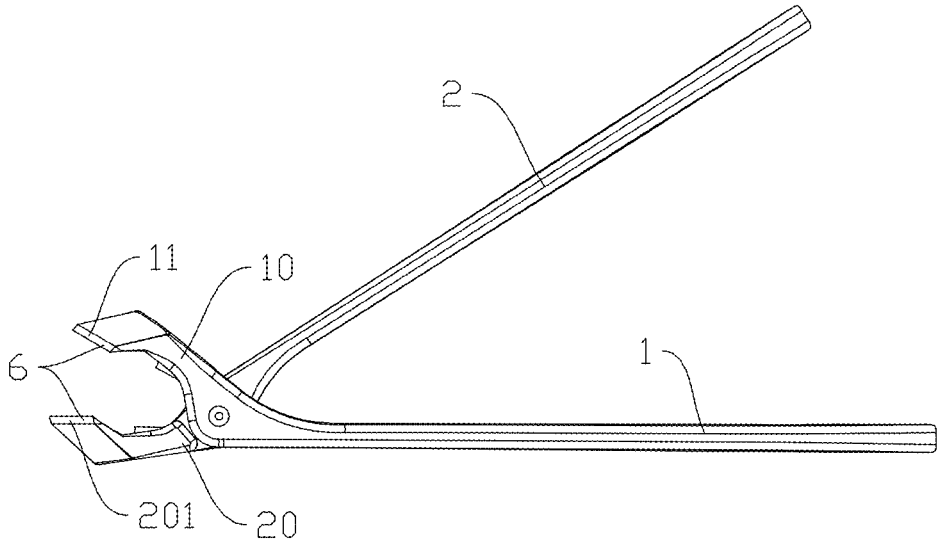
FIG. 2 is a side view of a nail clipper of the present disclosure without an elastic soft sleeve.
Figure 4:
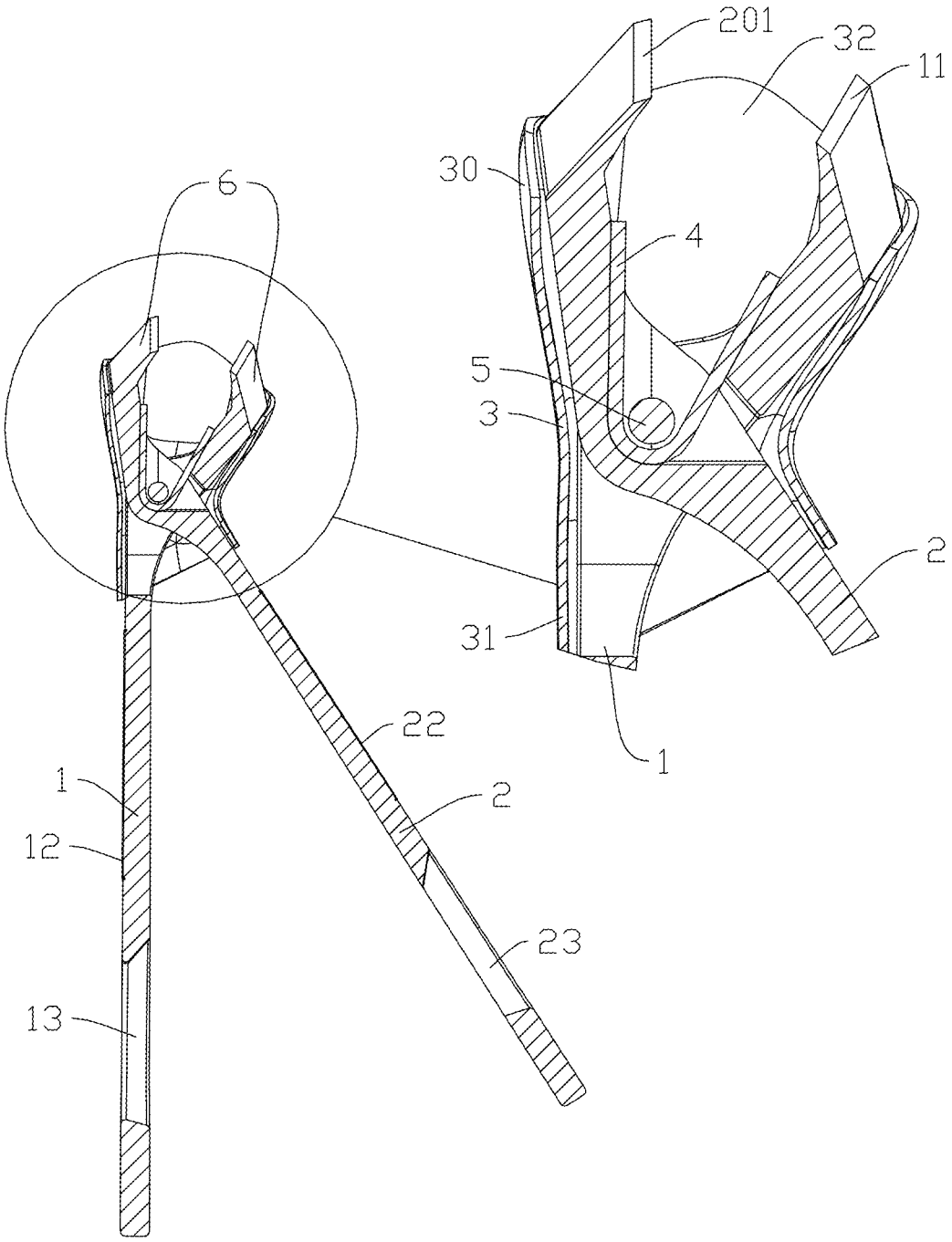
FIG. 4 is a sectional view of a nail clipper of the present disclosure.
Figure 5:
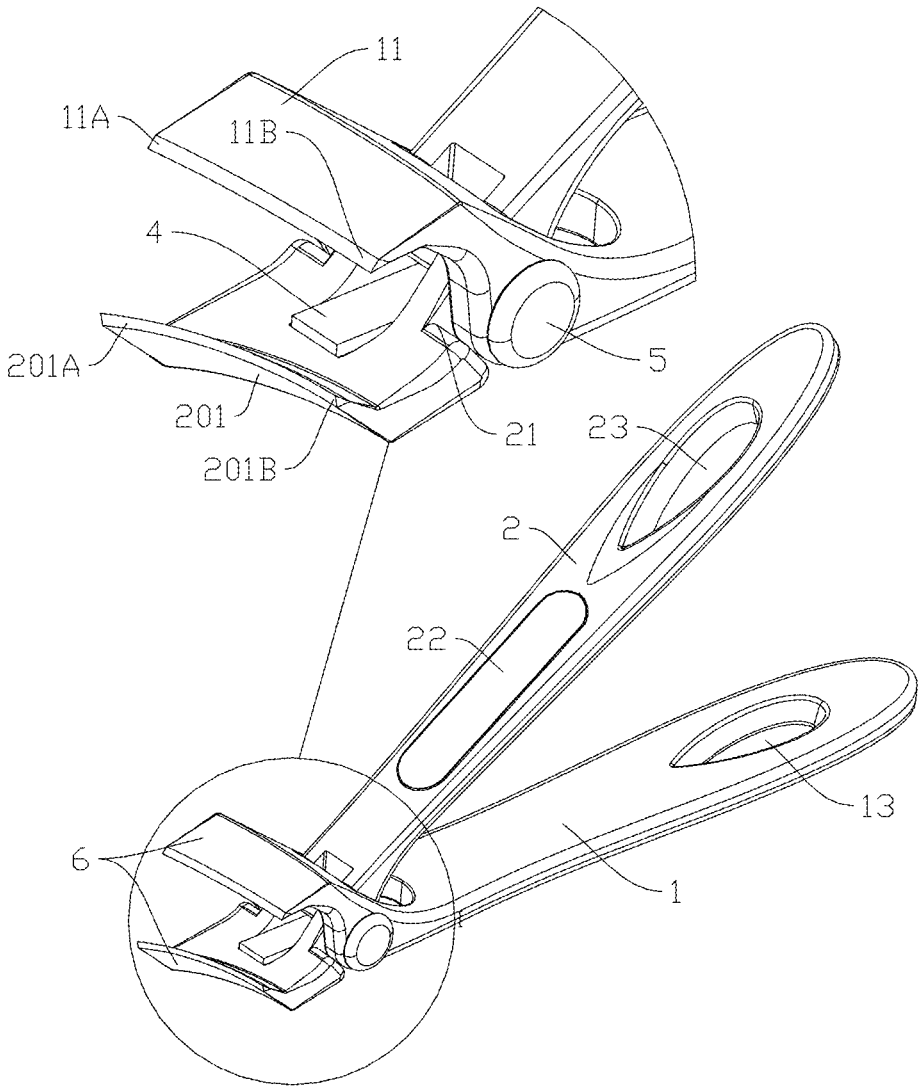
FIG. 5 is a partial view of a trimming blade head of the present disclosure.
Figure 6:
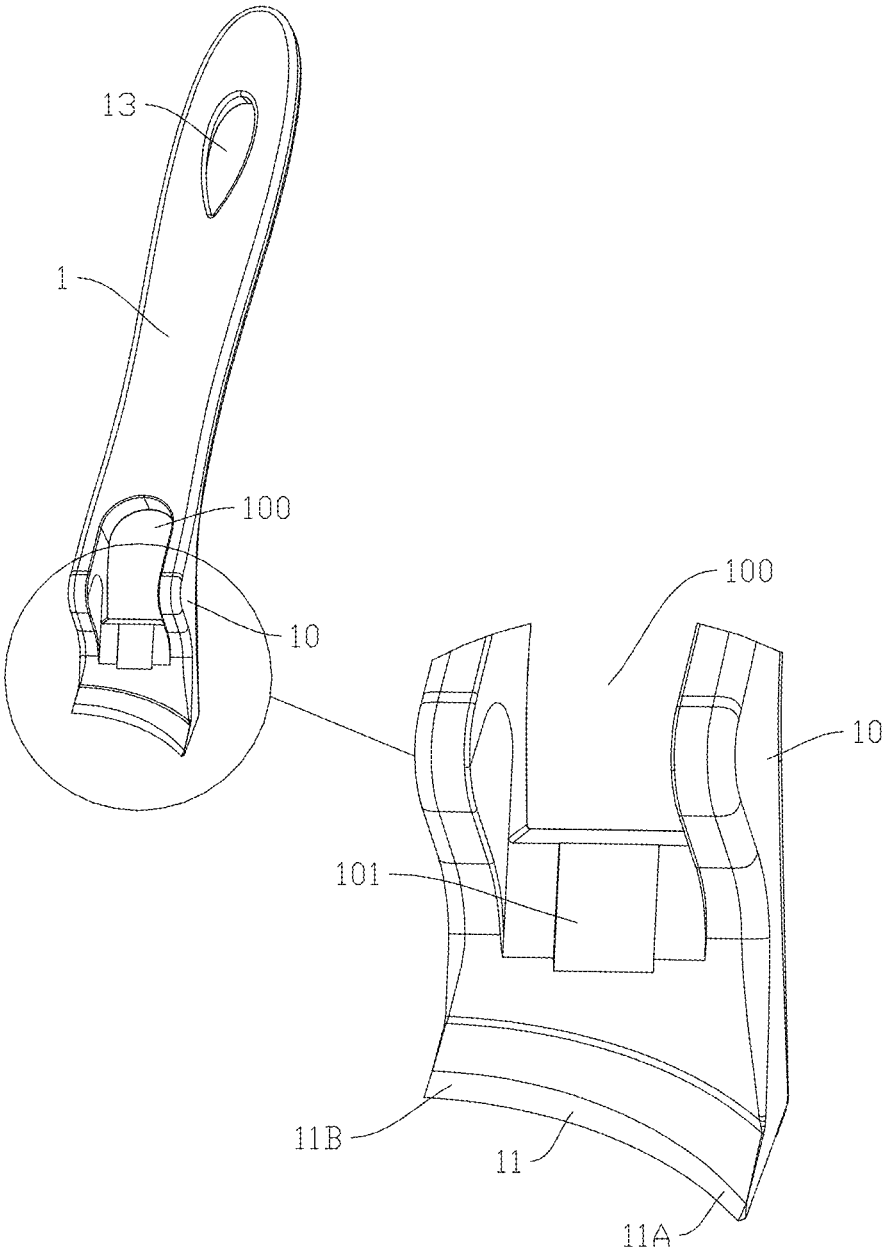
FIG. 6 is a schematic diagram of a first handle of the present disclosure.

The present disclosure discloses a wide-jaw-opening nail clipper, and as illustrated in FIGS. 1 and 2, the nail clipper includes a first handle 1 and a second handle 2;

as illustrated in FIGS. 4, 5 and 6, a first blade head portion 10 is formed at a head end of the first handle 1, the first blade head portion 10 is provided with a through slot 100 that penetrates through both upper and lower sides thereof, the through slot 100 is configured for insertion of the second handle 2, an upper blade 11 is formed at a front end of the first blade head portion 10, the upper blade 11 extends downward and forward, left and right ends of the upper blade 11 are denoted as an upper blade tip 11A and an upper blade tail 11B respectively, the upper blade tip 11A extends forward farther than the upper blade tail 11B, and the upper blade tip 11A forms a pointed cone shape; and during assembly, the second handle 2 penetrates through the through slot 100 and is butt-jointed with the first handle 1, where the through slot 100 limits rotation of the first blade head portion 10, thereby defining an opening width between the upper blade 11 and a lower blade 201.

Figure 7:
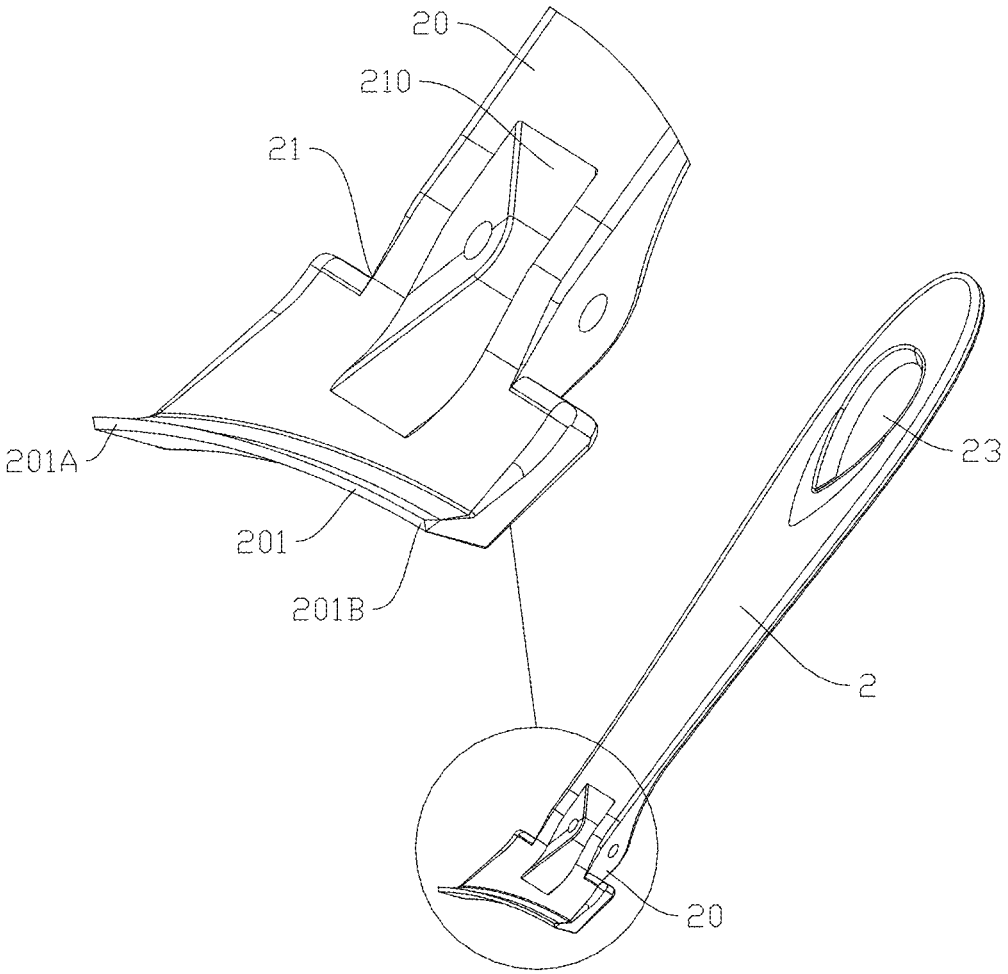
FIG. 7 is a schematic view of a second handle of the present disclosure.

As illustrated in FIGS. 4, 5 and 7, a second blade head portion 20 is formed at a head end of the second handle 2, the second blade head portion 20 is provided with a butt-joint position 21, the butt-joint position 21 serves as a butt-joint point between the first blade head portion 10 and the second blade head portion 20, the butt-joint position 21 is provided with a mounting groove 210, a lower blade 201 is formed at a front end of the second blade head portion 20, the lower blade 201 extends upward and forward, left and right ends of the lower blade 201 are denoted as a lower blade tip 201A and a lower blade tail 201B respectively, the lower blade tip 201A extends forward farther than the lower blade tail 201B, and the lower blade tip 201A forms a pointed cone shape;

as illustrated in FIGS. 4 and 5, the first blade head portion 10 is rotatably connected to the second blade head portion 20, an elastic member 4 is installed inside the mounting groove 210, both ends of the elastic member 4 abut against the first blade head portion 10 and the second blade head portion 20 respectively, and the elastic member 4 pushes the first blade head portion 10 and the second blade head portion 20 apart; and As illustrated in FIG. 2, the first blade head portion 10 and the second blade head portion 20 together form a trimming blade head 6 that tilts upward and forward.

Figure 3:
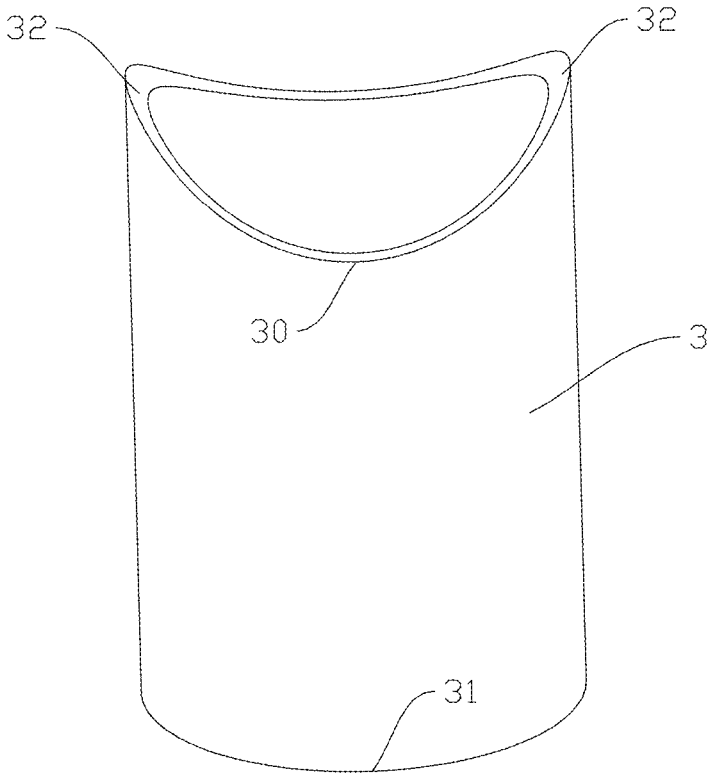
FIG. 3 is a schematic diagram of an elastic soft sleeve of the present disclosure.

Specifically, as illustrated in FIGS. 1 and 4, the nail clipper further includes: an elastic soft sleeve 3, the elastic soft sleeve 3 is mounted on the first blade head portion 10 and the second blade head portion 20 in a fitted manner, a head end 30 of the elastic soft sleeve 3 extends toward the trimming blade head 6, and a tail end 31 of the elastic soft sleeve 3 extends away from the trimming blade head 6;

blocking portions 32 are formed on both sides of the head end 30 of the elastic soft sleeve 3, the blocking portions 32 protrude from the head end 30 of the elastic soft sleeve 3, the blocking portions 32 are located on both sides of the upper blade 11 and the lower blade 201, and the blocking portions 32 are configured to block nail debris generated during trimming; and further, as illustrated in FIGS. 3 and 4, the blocking portions 32 are outwardly convex and arc-shaped, such that two recesses are formed at the head end 30 of the elastic soft sleeve 3, the two recesses are located on outer sides of the upper blade 11 and the lower blade 201 respectively, such that a user can observe the upper blade 11 and the lower blade 201 during trimming, thereby increasing convenience of trimming; and the blocking portions 32 enable full enclosing of both sides of the trimming blade head 6, thereby minimizing splatter of nail debris during the trimming. During use, a position of the elastic soft sleeve 3 on the trimming blade head 6 can be adjusted by pulling, such that positions of the blocking portions 32 on the trimming blade head 6 can be further adjusted.

Specifically, as illustrated in FIGS. 4-7, the elastic member 4 is V-shaped, the first blade head portion 10 is provided with a first limiting groove 101, the mounting groove 210 and the first limiting groove 101 limit the elastic member 4, and a rotating shaft 5 penetrates through the first blade head portion 10 and the mounting groove 210 and connects the first blade head portion 10 and the second blade head portion 20, where the rotating shaft 5 penetrates through a V-shaped curve of the elastic member 4. The above structure achieves limited installation of the elastic member 4, with a minimal friction between the elastic member 4 and the first blade head portion 10 and the second blade head portion 20, thereby effectively prolonging service life thereof.

Specifically, as illustrated in FIG. 1, a first through hole 13 is formed at an end of the first handle 1 away from the first blade head portion 10, a second through hole 23 is formed at an end of the second handle 2 away from the second blade head portion 20, and the first through hole 13 and the second through hole 23 achieve anti-slip functions.

Specifically, as illustrated in FIGS. 1 and 4, the first handle 1 and/or the second handle 2 is provided with a file, e.g., the first handle 1 is provided with a first file 12, and the second handle 2 is provided with a second file 22, where the files are configured for polishing nails and grinding nail tips, and the files are preferably nano-glass files.

To sum up, the trimming blade head that tilts upward and forward allows the user to hold the nail clipper vertically during trimming, which reduces an amplitude of wrist bending during the trimming; the trimming blade head with pointed cone-shaped blades facilitates trimming of ingrown nails by the user;

a traditional external spring structure is changed to an internal spring structure, which simplifies a structure of the two handles, and reduces manufacturing costs, where the internal spring is more durable than the traditional external spring; and arrangement of the nano-glass files facilitates nail polishing by the user, and the nano-glass files are superior to traditional metal files in terms of polishing properties; and the elastic soft sleeve enables full enclosing of both sides of the trimming blade head, which minimizes the splatter of nail debris during the trimming, neither affects normal trimming in a blade direction, nor obstructs the user's observation of the blades during the trimming, and nor limits the opening width of the blades.

In the description of the present disclosure, it should be noted that the terms "center", "upper", "lower", "left", "right", "vertical", "horizontal", "inner", "outer", etc. indicate azimuthal or positional relations based on those shown in the drawings only for ease of description of the present disclosure and for simplicity of description, and are not intended to indicate or imply that the referenced device or element must have a particular orientation and be constructed and operative in a particular orientation, and thus may not be construed as a limitation on the present disclosure. In addition, the terms "first" and "second" are for descriptive purposes only and should not be construed as indicating or implying relative importance. The terms "first position" and "second position" refer to two different positions.

In the description of the present disclosure, it is also noted that unless expressly specified and defined otherwise, the terms "mount", "connected" and "connect", etc. should be understood in a board sense. For example, the connection may be a fixed connection or a detachable connection; may be a mechanical connection or an electrical connection; may be a direct connection or an indirect connection by using an intermediate medium; or may be intercommunication between two components. For those of ordinary skill in the art, the specific meanings of the above terms in the present disclosure may be understood according to specific circumstances.

The above examples are merely one or more embodiments of the present disclosure, and are specifically described in details, but may not be interpreted as limiting the scope of the patent for the present disclosure as a result. It shall be noted that for those of ordinary skill in the art, they may also make several transformations and improvements on the premise of not deviating from the conception of the present disclosure, and these transformations and improvements shall fall within the scope of protection of the present disclosure. Hence, the scope of protection of the present disclosure shall be subject to the appended claims.

What is claimed is:

1. A wide-jaw-opening nail clipper, comprising a first handle and a second handle;

a first blade head portion is formed at a head end of the first handle, the first blade head portion is provided with a through slot that penetrates through both upper and lower sides thereof, the through slot is configured for insertion of the second handle, an upper blade is formed at a front end of the first blade head portion, the upper blade extends downward and forward, left and right ends of the upper blade are denoted as an upper blade tip and an upper blade tail respectively, the upper blade tip extends forward farther than the upper blade tail, and the upper blade tip forms a pointed cone shape;

a second blade head portion is formed at a head end of the second handle, the second blade head portion is provided with a butt-joint position, the butt-joint position is provided with a mounting groove, a lower blade is formed at a front end of the second blade head portion, the lower blade extends upward and forward, left and right ends of the lower blade are denoted as a lower blade tip and a lower blade tail respectively, the lower blade tip extends forward farther than the lower blade tail, and the lower blade tip forms a pointed cone shape;

the first blade head portion is rotatably connected to the second blade head portion, an elastic member is installed inside the mounting groove, both ends of the elastic member abut against the first blade head portion and the second blade head portion respectively, and the first blade head portion and the second blade head portion together form a trimming blade head that tilts upward and forward.

2. The wide-jaw-opening nail clipper according to claim 1, further comprising: an elastic soft sleeve, wherein the elastic soft sleeve is mounted on the first blade head portion and the second blade head portion, a head end of the elastic soft sleeve extends toward the trimming blade head, and a tail end of the elastic soft sleeve extends away from the trimming blade head; and blocking portions are formed on both sides of the head end of the elastic soft sleeve, the blocking portions protrude from the head end of the elastic soft sleeve, the blocking portions are located on both sides of the upper blade and the lower blade, and the blocking portions are configured to block nail debris generated during trimming.

3. The wide-jaw-opening nail clipper according to claim 2, wherein the blocking portions are outwardly convex and arc-shaped.

4. The wide-jaw-opening nail clipper according to claim 1, wherein the elastic member is V-shaped.

5. The wide-jaw-opening nail clipper according to claim 4, wherein the first blade head portion is provided with a first limiting groove, and the mounting groove and the first limiting groove limit the elastic member.

6. The wide-jaw-opening nail clipper according to claim 5, wherein a rotating shaft penetrates through the first blade head portion and the mounting groove and connects the first blade head portion and the second blade head portion, wherein the rotating shaft penetrates through a V-shaped curve of the elastic member.

7. The wide-jaw-opening nail clipper according to claim 1, wherein a first through hole is formed at an end of the first handle away from the first blade head portion.

8. The wide-jaw-opening nail clipper according to claim 7, wherein a second through hole is formed at an end of the second handle away from the second blade head portion.

9. The wide-jaw-opening nail clipper according to claim 1, wherein the first handle and/or the second handle is provided with a file.

10. The wide-jaw-opening nail clipper according to claim 9, wherein the files are nano-glass files.

* * * * *